United States Patent [19]

Orvis

[11] Patent Number: 4,540,096

[45] Date of Patent: Sep. 10, 1985

[54] TRUSS BOOM

[76] Inventor: Victor R. Orvis, 1250 N. Ralston St., Anaheim, Calif. 92801

[21] Appl. No.: 643,437

[22] Filed: Aug. 23, 1984

[51] Int. Cl.[3] ..... B66F 3/36

[52] U.S. Cl. ..... 212/177; 212/267; 414/724

[58] Field of Search ..... 212/168, 177, 187, 188, 212/229, 230, 252, 264, 266, 267; 414/724, 607

[56] References Cited

U.S. PATENT DOCUMENTS

| | | | |
|---|---|---|---|
| 368,955 | 8/1887 | Lacey | 212/252 |
| 1,539,546 | 5/1925 | Deenik | 212/228 |
| 3,021,014 | 2/1962 | Korensky et al. | 212/177 |
| 3,249,238 | 5/1966 | Hedeen et al. | 212/266 |
| 3,698,569 | 10/1972 | Lamer et al. | 212/177 |
| 3,788,492 | 1/1974 | Kraft | 414/607 |
| 4,002,242 | 1/1977 | Eriksson | 212/177 |
| 4,159,059 | 6/1979 | Christenson et al. | 212/177 |
| 4,200,423 | 4/1980 | Sornsin | 414/724 |
| 4,251,181 | 2/1981 | Drott et al. | 414/723 |

*Primary Examiner*—Trygve M. Blix
*Assistant Examiner*—Stephen P. Avila
*Attorney, Agent, or Firm*—Hubbard, Stetina & Brunda

[57] ABSTRACT

A truss boom having an extension member equipped with a pulley and a hook, comprising a pyramidal support frame is disclosed.

6 Claims, 3 Drawing Figures

TRUSS BOOM

FIELD OF THE INVENTION

This invention relates to material handling booms and, specifically, to a truss boom for material handling.

BACKGROUND OF THE INVENTION

Truss booms for material handling are well known. For example, Christenson, et al., U.S. Pat. No. 4,159,059, June 26, 1979, discloses a truss boom for a material handling truck, in which a truss boom attachment for mounting to a fork assembly on a material handling truck is disclosed. Drott, et al., U.S. Pat. No. 4,251,181, Feb. 17, 1981, discloses a coupling apparatus for truss booms, and the like.

Truss booms are used in construction, usually in the construction of one, two, and sometimes three story buildings. They are useful, primarily, in the placement of truss assemblies in position along the length of the building at the roof or between floors. Trusses are large and require very specific placement. It is common to use a hydraulically driven arm to place loads at higher levels. However, in handling trusses, special problems are encountered in that the truss is particularly cumbersome and difficult to handle and must be lifted to higher levels than ordinarily experienced in material handling.

Truss booms, such as described by Christenson, et al., have been designed and have been in use for some time. A problem common among truss booms, however, is that their load carrying capacity is very limited and they are not adjustable insofar as the length of the boom is concerned. Sometimes, it is not possible to maneuver the truck into a satisfactory position for using a conventional boom, such as is disclosed by Christenson, et al., for example.

The present invention overcomes the deficiencies of the prior art by a unique truss boom design in which the truss boom is extensible and the truss boom includes a compression member and two extension members, the load being carried directly along the compression member, rather than offset, as is conventional.

BRIEF SUMMARY OF THE INVENTION

The present invention comprises the combination extensible boom for lifting and positioning building trusses. The boom includes a rear frame which comprises upper and lower support bars which are generally parallel and spaced from one another. A plurality of spacer bars extend between the support bars to hold the support bars in fixed spaced generally parallel relationship. At least two of the spacer bars extend from spaced unions with the upper support bar to a single union generally centered in the lower support bar. These two spacer bars and that portion of the upper support bar between the unions of the support bar with the spacer bars comprise the triangular base of a pyramidal support frame. Means are provided for securing the rear frame to a moveable boom, the moveable boom, however, not comprising part of the present invention. A generally pyramidally configured support frame is secured with the aforesaid two spacer bars and portion of the upper support bar forming the base thereof. The support frame comprises three support beams. Two of the support beams are in tension and, thus, are referred to as tension beams, and one of the support beams is a compression beam. The tension beams are secured at their rear end thereof to the upper support bar proximate the spaced unions of the support bar with the spacer bars. The third support beam is a compression beam secured at the rear end thereof to the lower support bar proximate the single union of the two spacer bars in the center of the lower support bar. Means are provided, generally in the form of a plate at which the ends of the beams are welded, for securing the forward end of all three support beams together. The compression beam is hollow and is adapted to slideably receive a fourth beam. A fourth support beam is slideably received for reciprocal movement in the compression beam and, preferably, includes a locking means, such as a pin, to fix the position of the fourth support beam in and relative to the compression beam. Means are provided on the front end of the support beam for connecting to a load for supporting the load an adjustable distance from the rear frame. The means includes both a pulley and a hook, in the preferred embodiment. In order to provide greater strength, three spacer beams forming a triangle are secured at each end between the three support beams at a point between the rear frame and the means securing the forward end of the support beams together. In the preferred embodiment, two or more triangular arrangements of spacer beams are thus provided. In the present invention, the beams are preferably formed of $\frac{1}{4}$ inch wall thickness square, hollow, steel beams having a diameter of from $2\frac{1}{2}$ inches to 4 inches.

DESCRIPTION OF THE PREFERRED EMBODIMENT

Figures 1, 2, 3:
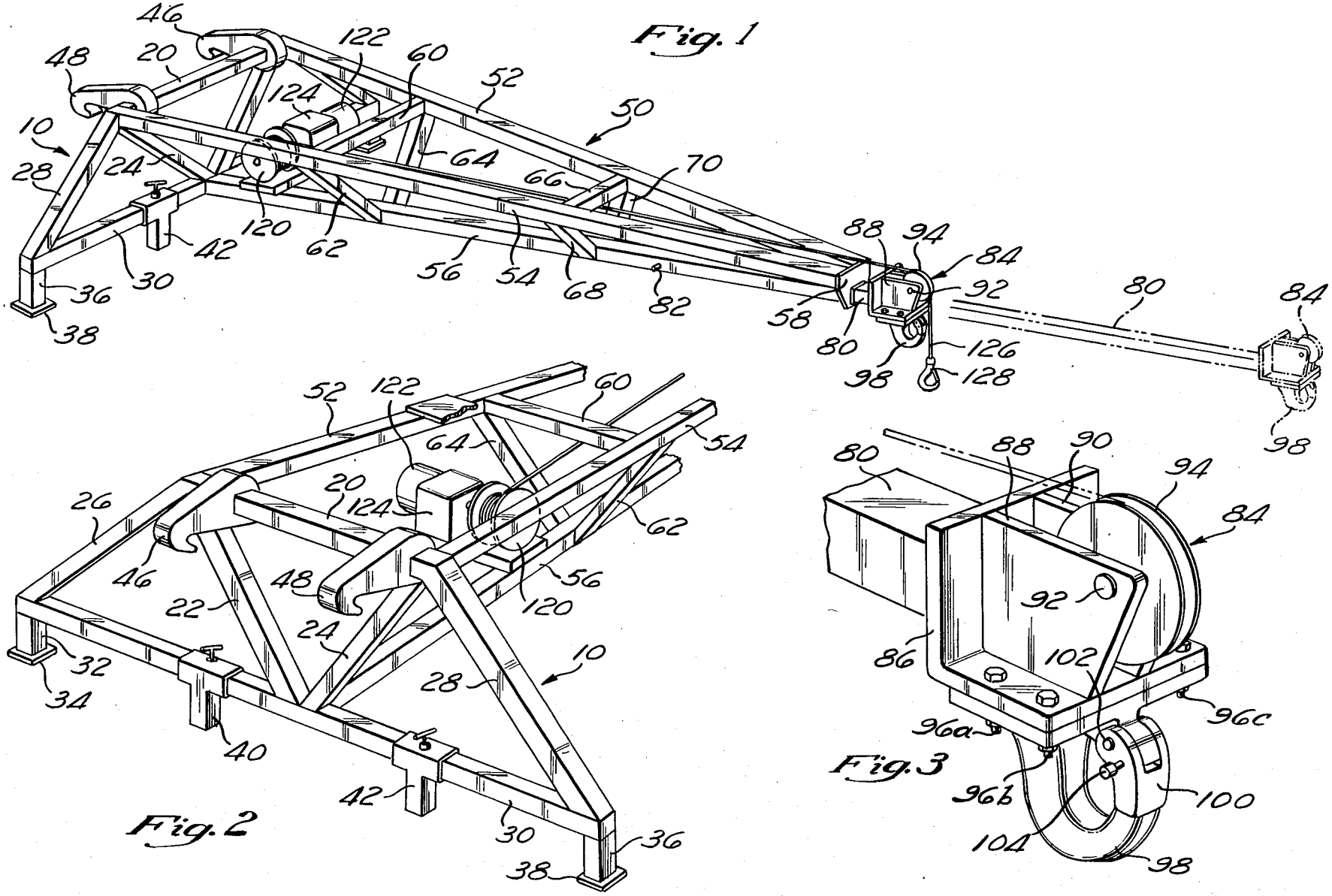
FIG. 1 depicts the truss boom of the present invention showing its extended position by phantom lines.
FIG. 2 shows the rear frame portion of the present invention.
FIG. 3 shows the load connection means of the present invention, in a preferred form.

The present invention comprises a rear frame 10, best shown in FIG. 2. The rear frame 10 comprises an upper support bar 20 and a lower support bar 30 and a plurality of spacer bars 22, 24, 26, and 28. Additional spacer bars may be used if desired. It would be noted that the upper support bar 20 is shorter than the lower support bar 30, in this embodiment.

It is very significant that two of the spacer bars 22 and 24 are connected at one end in a union with the center of the lower support bar and at the other end at spaced positions on the upper support bar. The portion of the upper support bar 20 between the union therewith of the two spacer bars and the spacer bars 22 and 24 forms a triangle which is the base of a pyramidal support frame to be described.

A series of support legs 32, with foot 34, and 36, with foot 38, space the lower support bar above the ground to allow a fork to extend underneath the truss boom when the boom is used in connection with a fork lift. Guides 40 and 42 are adjustable truss or beam controllers which can be locked at any desired spacing.

A pair of hooks 46 and 48 secured to the upper support bar 20 proximate the joint of the spacer bars 22 and 24 and, as will be described, the tension support beams secure the boom to the lift truck or boom head or carriage.

Referring now to FIG. 1, a generally pyramidally configured support frame comprising three elongate support beam, generally indicated at 50, provides the extension for supporting trusses for which the invention is designed. Two of the support beams 52 and 54 are secured at the rear end thereof to the upper support bar proximate the spaced unions of the support bar with the spacer bar. One of the support beams 56 is a compression beam secured at the rear end thereof to the lower support bar proximate the single union of the spacer bars in the center of the lower support bar. The support beams 52 and 54 are tension members, being in tension when the boom is under load. The third support beam 56 is a compression member, being in compression when the boom is under load. Means such as a plate 58 secure the forward end of all three support beams together. The compression beam 56 is hollow and is adapted to slideably receive a fourth beam to be described. The support frame comprises at least one set, preferably two or more sets, of three spacer beams such as shown at 60, 62, and 64 and, respectively, at 66, 68, and 70, forming a triangle and secured at each end between the rear frame elongate support beams at points between the rear frame and the means securing the forward end of the support beams together. All of the elements thusfar described are secured together by welding. Multiple pass weld joints are used to provide maximum strength. The support beams, and preferably all other beams, are made of heavy duty steel, preferably ¼ inch in wall thickness and 2½ to 4 inches in width and height.

The fourth beam 80 is reciprocally received in the compression beam 56. A pin 82 or other means for locking the fourth beam in position in and relative to the compression beam is provided. The pin simply extends through an aperture through the walls of the respective beams 56 and 80.

Load attachment means generally shown at 84 are secured at the end of the beam 80. In the preferred form, the load attachment means comprises an L-shaped plate 86 with a pair of gusset plates 88 and 90 having an aperture formed therein, in alignment, through which an axle pin 92 extends, on which a rotatable pulley 94 is mounted. Bolts 96, **96*a*, 96*b*, and 96*c* being shown, secure a hook 98 which, preferably, includes a keeper assembly 100, pivot pin 102, and locking pin 104. It is to be clearly understood, however, that insofar as the load attachment means is concerned, the hook and pulley shown are simply exemplary of any of a very large number of types of pulleys and hooks and attachment means which may be used. It is a very significant and definite advantage, however, to provide both a pulley and a hook. In the prior art, either a pulley or a hook has been provided, but it was necessary to change the structure between uses. By the present design, either a pulley or a hook or both in combination may be used. A winch 120 and electric or hydraulic motor 122 and gear box 124 are very advantageously mounted inside the truss boom and wind cable 126 with hook 128 to permit lifting of loads while the boom is stationary. This unique mounting location inside the winch protects the winch and the cable, and transmits the load from the cable to the compression member of the truss. Convenience and load carrying capacity are increased. A winch on the forklift can also be used by rotating the fourth beam 80**, 180 degrees, and bringing the cable underneath the boom.

It will be understood, now, that, when the boom is placed under load, the load is carried by compression of the heavy duty beam 56 and tension of beams 52 and 54, the compression being carried directly along the beam 56. In the prior art truss booms, such as that described by Christenson, et al., the compression members were spaced from each other and, generally, were made of lighter metal. Considerable difficulty has been experienced in the collapse of booms of the type generally described. The present boom is much stronger and more resistant to collapse than the prior art booms because of the pyramidal configuration of the support frame.

Another very significant advantage of the present invention is that the load attachment means, the hook or the pulley, is extensible and can be extended out to any desired extent, within the structural limits of the boom and the load carrying capacity of the beam 80, to permit lifting of trusses higher and further, when necessary, and also to permit collapsing of the boom for convenience in normal use.

INDUSTRIAL APPLICATION

The present invention finds industrial application in the construction industry, primarily, and may be used in any other industry in which a boom is suitable for use.

What is claimed is:

1. A truss boom especially constructed and adapted to attach to a lifting machine for extending over and lifting trusses at construction sites, comprising a separable, unitary combination of:

a tetrahedral open space truss formed of six beams, there being three short beams and three longer beams a multiplicity of times longer than the three short beams, the three short beams united at their respective ends together to form a generally equilateral triangle, the proximal ends of each of the longer beams secured to the aforesaid respective unions of the short beams, and the distal ends of each of the longer beams secured substantially together by distal securing means, said space truss being so constructed and configured that when in use, at least one of the longer beams is in compression, and at least one of the longer beams is in tension;

at least one set of three brace beams intermediate the ends of the longer beams, each of said brace beams being united at their respective ends with the longer beams adjacent one another to form at least one triangular brace structure securing the three longer beams together intermediate the ends thereof;

lifting machine connection means secured to the triangle formed by the union of the short beams of the open space truss, said lifting machine connection means being constructed and adapted to facilitate connection of the open space truss to a lifting machine;

support means secured to the triangle formed by the union of the short beams of the open space truss construction comprising means for supporting said triangle a predetermined distance above a supporting surface when the open space truss is not in use; and truss connection means secured to the distal securing means for attaching a truss to the truss boom.

2. The truss boom of claim 1 further comprising winch means inside the open space truss and a cable extending through the open space truss, and connected to the truss connection means for lifting or lowering the truss connection means relative to the distal securing means.

3. The truss boom of claim 2 wherein the means for connection to a lifting machine comprises hook means, and the support means comprises laterally extending beam means and support leg means extending downwardly therefrom for engaging the support surface, and supporting the truss boom when not in use.

4. The truss boom of claim 1 wherein the means for connection to a lifting machine comprises hook means, and the support means comprises laterally extending beam means and support leg means extending downwardly therefrom for engaging the support surface, and supporting the truss boom when not in use.

5. A truss boom especially constructed and adapted to attach to a lifting machine for extending over and lifting trusses at construction sites, comprising a separable, unitary combination of:

a tetrahedral open space truss formed of six beams, there being three short beams and three longer beams a multiplicity of times longer than the three short beams, the three short beams united at their respective ends together to form a generally equilateral triangle, the proximal ends of each of the longer beams secured to the aforesaid respective unions of the short beams, and the distal ends of each of the longer beams secured substantially together by distal securing means, said space truss being so constructed and configured that when in use, two upper longer beams are in tension, and a lower longer beam is in compression;

four short base beams, two of which extend laterally from a union of the short open space truss beams, and two of which extend respectively from the other two unions of the open space truss beams to the ends of the aforesaid lateral base beams, the three short beams of the open space truss, and the four short base beams being united together at their respective ends to form three planar triangles, two of the short open space truss beams comprising a beam of two separate triangles;

at least one set of three brace beams intermediate the ends of the longer beams, each of said beams being united at their respective ends with the longer beams adjacent one another to form at least one triangular brace structure securing the three longer beams together intermediate the ends thereof;

hook means secured to the triangle formed by the union of the short beams of the open space truss constructed and adapted to facilitate connection of the open space truss to a lifting machine;

a plurality of legs secured to the brace beams, and extending downwardly therefrom a predetermined distance for supporting the proximal end of the truss boom said distance above a supporting surface when the open space truss is not in use; and truss connection means secured to the distal securing means for attaching a truss to the truss boom.

6. The truss boom of claim 5 further comprising a plurality of moveable legs and means securing the legs to the brace beams for being moved and secured at selected positions on said brace beams.

* * * * *